United States Patent [19]

Gerwick, Jr.

[11] Patent Number: 4,901,498

[45] Date of Patent: Feb. 20, 1990

[54] T-HEADED STIRRUP FOR REINFORCED CONCRETE STRUCTURES

[75] Inventor: Ben C. Gerwick, Jr., San Francisco, Calif.

[73] Assignee: Sohio Petroleum Company, Houston, Tex.

[21] Appl. No.: 778,991

[22] Filed: Sep. 23, 1985

[51] Int. Cl.[4] ..... E04C 5/16

[52] U.S. Cl. ..... 52/650; 52/687

[58] Field of Search ..... 52/677–689, 52/225, 226, 231, 414, 650

[56] References Cited

U.S. PATENT DOCUMENTS

| | | | |
|---|---|---|---|
| 987,858 | 3/1911 | Collins | 52/714 |
| 1,268,887 | 6/1918 | Schroeder | 52/687 |
| 1,613,351 | 1/1927 | Klinger et al. | 52/684 |
| 1,674,204 | 6/1928 | Johnson | 52/650 |
| 2,157,271 | 9/1939 | Schmeller | 72/44 |
| 2,467,115 | 4/1949 | Duggan | 52/677 |
| 3,286,419 | 11/1966 | Eriksson | 52/225 |

OTHER PUBLICATIONS deha Anersysteme "Dubelleiste", (Illustrated literature on shear studs) Permit dated Jul. 29, 1980.

*Primary Examiner*—James L. Ridgill, Jr.
*Attorney, Agent, or Firm*—Raymond F. Keller; David J. Untener; Larry W. Evans

[57] ABSTRACT

A T-headed stirrup for anchoring reinforcing bars in concrete, to restrain lateral buckling of the reinforcing bars under severe forces. The stirrup, comprising a shaft with a T-shaped crosspiece at each end, is typically inserted between pairs of reinforcing bars. The crosspiece contacts the reinforcing bar and is shaped to restrain lateral movement of the reinforcing bar.

10 Claims, 2 Drawing Sheets

Fig. 1
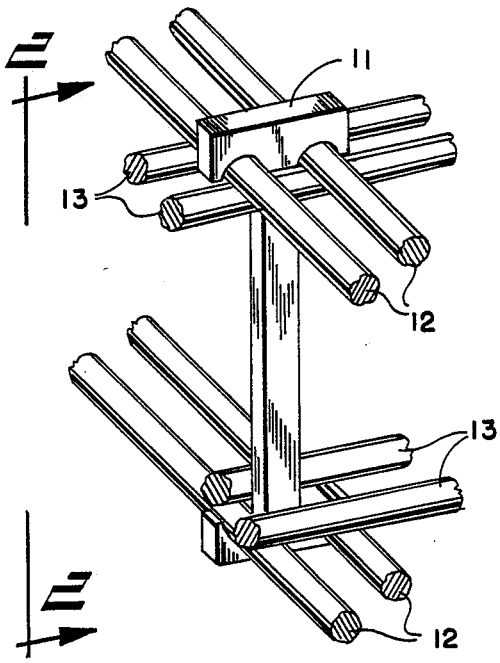
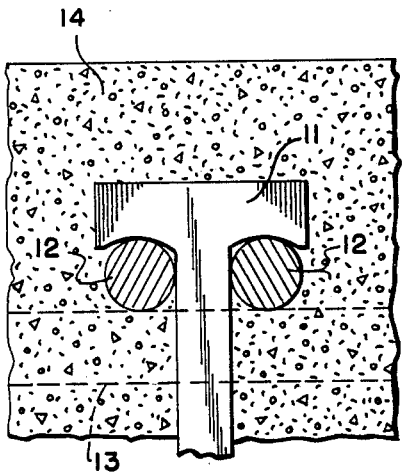
Fig. 4
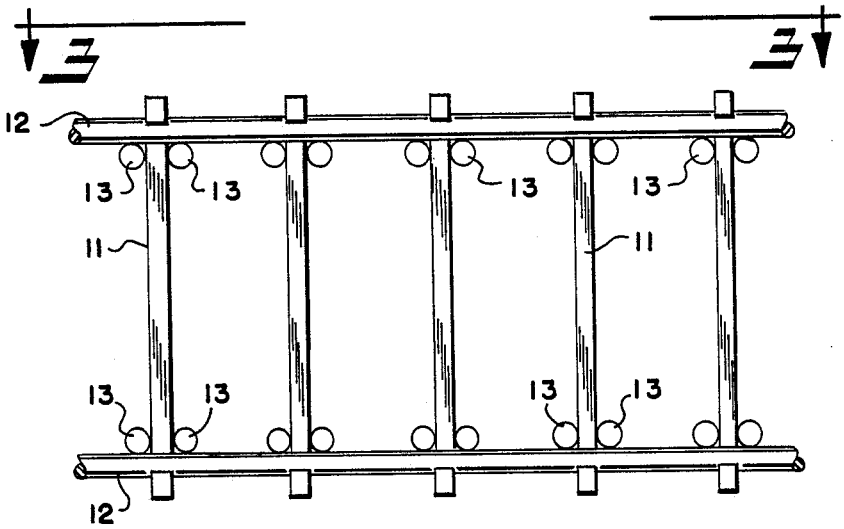
Fig. 2

T-HEADED STIRRUP FOR REINFORCED CONCRETE STRUCTURES

BACKGROUND OF THE INVENTION

1. Field of the Invention

The invention relates to reinforcement for concrete structures. In particular, the invention relates to a T-headed stirrup which is useful for providing high resistance to punching shear in concrete walls and in restraining buckling of reinforcing bars under high compression.

2. Description of the Related Art

Reinforced concrete is commonly used in construction. Metal reinforcements are used to improve the strength of concrete structures subjected to severe loads and forces, particularly tensional and shear forces. Steel reinforcing members are often placed both longitudinally and transversely within such structures.

Reinforced concrete is desirable in ocean and arctic construction, such as in a shaft or caisson designed to resist the impact of boats, movement of icebergs or sea ice, explosion, etc. In walls, for example, the primary reinforcement to resist bending (flexure) is placed near each face of the wall, i.e., near both the interior and exterior face. This reinforcement consists of either individual bars or bundles of bars on relatively close spacing, which run in two orthogonal directions, usually horizontally and vertically. To resist punching shear, transverse reinforcement (such as a stirrup) is also installed on close spacing, locking around the primary reinforcement.

According to a definition in "Cement and Concrete Terminology" in the *ACI Manual of Concrete Practice* (Part 2—1983, American Concrete Institute, Detroit, Mich.), a stirrup is a reinforcement used to resist shear and diagonal tension stresses in a structural member; it is typically a steel bar bent into a U or box shape and installed perpendicular to or at an angle to the longitudinal reinforcement, and is properly anchored.

Further discussion of bar stirrups can be found in *Reinforced Concrete Fundamentals,* Fourth Edition, by Phil M. Ferguson (New York: John Wiley & Sons, 1979). As explained therein, a stirrup in a reinforced concrete beam can be a simple bar which is well anchored in the compression zone of the beam and is bent around the longitudinal tension bars, so that it functions as vertical reinforcement. As shear stress is applied, the stirrup goes into tension and thus controls and limits the progress of any cracking of the concrete. Until the stirrup either pulls out or yields, the beam will not experience shear failure.

In a horizontal concrete beam which contains both longitudinal and transverse reinforcement, stirrups provide "vertical" reinforcement. In certain structures such as sea walls designed to resist lateral forces, the stirrups are actually horizontal, not vertical. For uniformity of description in this patent, stirrups will be said to provide "perpendicular" reinforcement since they tend to restrain movement perpendicular to the plane formed by the longitudinal and transverse reinforcement.

With conventional bar stirrups, the amount of perpendicular reinforcement is physically limited by geometry and the allowable bend radii. Failure of conventional stirrups is usually by crushing under the bend or pull out of the bar ends, well below yield, thus making the stirrups inefficient. Conventional stirrups also require extensive labor to place.

Stirrups consisting of planar plates welded onto the ends of shafts are an improvement over simple bars because the plates can be anchored behind the primary reinforcement. However, failure of these occurs when the concrete cover, outside the reinforcement, spalls and the primary reinforcing bars deflect sideways. This type of stirrup is also difficult to place.

An improvement over simple bar stirrups or similar mechanical anchorages can be found in the prior art. U.S. Pat. No. 2,157,271 to E. E. Schmeller discloses a concrete wall structure, where the interior structure of the wall section is reinforced by the use of wires that are crossed to form the usual mesh, and are used in conjunction with cast metal tie bars extending transversely of the section and fashioned with retaining heads imbedded in the face walls.

Another improvement has been made over stirrups with headed plates and bars such as described in Schmeller. Instead of a planar endplate, a shaft having T-heads at opposing ends and substantially flat surfaces was devised. This flat shape made it practical to insert the T-headed stirrup between two closely-spaced reinforcing bars, then turn the stirrup ninety degrees so that the T-head contacted the reinforcing bar.

A flat T-headed stirrup provided satisfactory performance by inhibiting transverse buckling of the longitudinal reinforcing bars in concrete. However, once the concrete surface covering the reinforcing bars had spalled, lateral buckling and movement of the reinforcing bars was essentially unrestrained.

SUMMARY OF THE INVENTION

This invention provides a means for restricting movement of a reinforcing member in concrete, comprising a shaft having a crosspiece at both ends, with each crosspiece being perpendicular to the shaft and parallel one to the other, and each crosspiece having a proximal and distal surface relative to the end of the shaft, said proximal surface having at least one reentrant. In a preferred embodiment, the stirrup has a flat T-headed shape with curved inside faces for restraining a reinforcing bar. Another embodiment of the invention is a reinforced concrete structure having at least two parallel reinforcing members such as steel reinforcing bars, wherein a double-headed stirrup as described is placed to restrain both vertical and lateral movement of the reinforcing member relative to the stirrup.

BRIEF DESCRIPTION OF THE DRAWINGS

FIG. 1 shows a single stirrup in conjunction with two pairs of longitudinal and transverse reinforcing bars.

FIG. 2 is a side view of several stirrups, with the longitudinal reinforcing bars visible and the transverse reinforcing bars appearing in cross-section.

FIG. 4 is a detailed cross-sectional view of the top of a stirrup showing a preferred shape of of the T-head, and its relationship to the reinforcing bars and concrete.

The Figures are described below in more detail.

DESCRIPTION OF THE PREFERRED EMBODIMENT

The drawings are useful in understanding the nature of the invention, although it should be understood that the invention is not limited to the preferred embodiment which has been illustrated.

Referring to FIG. 1, a single stirrup 11 is shown with the shaft visible, the top crosspiece visible, and the opposite crosspiece being partially obscured by the reinforcing bars. The shaft intersects each crosspiece at about the midpoint of the crosspiece. Immediately adjacent to the inside of each crosspiece is a pair of parallel longitudinal reinforcing bars 12. Pairs of transverse reinforcing bars 13 are situated inside and at right angles to each pair of longitudinal reinforcing bars 12.

Each crosspiece on the stirrup 11 can be considered to have a proximal and distal surface relative to the end of the shaft. The proximal surface contacts the reinforcing bars 12. Each crosspiece as shown in FIG. 1 has two reentrants so located as to restrain the bars 12 from lateral movement.

For purposes of this patent, a "reentrant" is any inwardly-directed portion or identation of the proximal surface of the crosspiece. The shape of the reentrant is most preferably a concave arc to correspond to the circumference of the chosen reinforcing bar 12 as illustrated in FIG. 1. Preferably, the radius of the concave arc reentrant is at least as long as the radius of the reinforcing bar 12 (viewed in cross-section), and most preferably is only slightly longer. However, even a moderately curved reentrant such as shown in FIG. 4 or a non-curvilinear reentrant (not shown) can be used. Moderately curved reentrants will make assembly of the reinforcing steel complex easier, while deeper reentrants will be more effective in restraining movement of the reinforcement bars.

FIG. 2 shows a side view of an array of stirrups, with one of each pair of longitudinal reinforcing bars 12 visible, and the ends of several pairs of transverse reinforcing bars 13 also visible.

Figure 3:
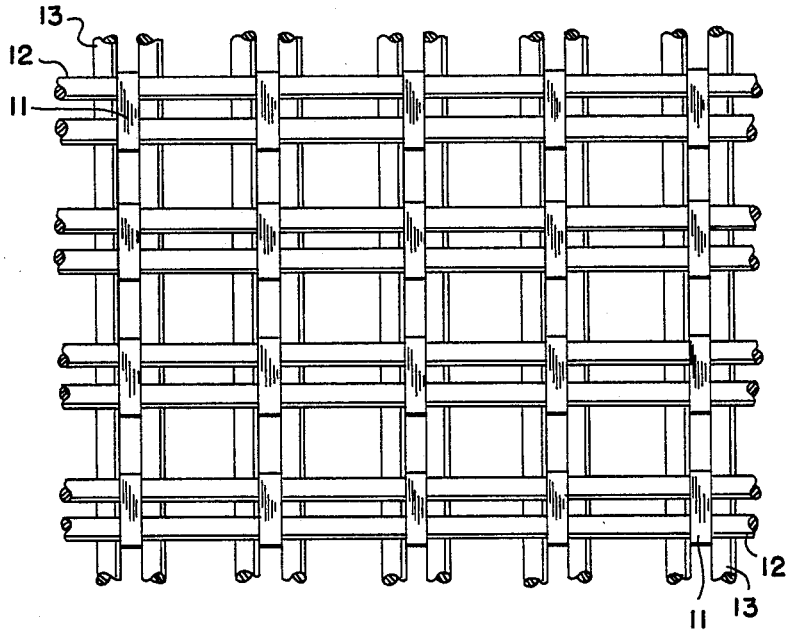
FIG. 3 is a top view of an array of stirrups, with the adjacent longitudinal and transverse reinforcing bars visible.

FIG. 3 represents a top view of the reinforcing system found in a concrete wall. Only the top (distal surface) of one crosspiece of each stirrup 11 is visible. Below the crosspiece of the stirrup 11 are pairs of longitudinal reinforcing bars 12, and below them are the transverse reinforcing bars 13. The relative spacing of the stirrups and reinforcing bars can, of course, vary depending upon the design requirements of the concrete structure.

FIG. 4 represents a fragmentary cross-sectional view of a finished section of reinforced concrete 14. Longitudinal reinforcing bars 12 are shown just below the fragment of the stirrup 11. Although the transverse reinforcing bars 13 would not be visible in this cross-section, their position is indicated by broken lines.

Figure 5:
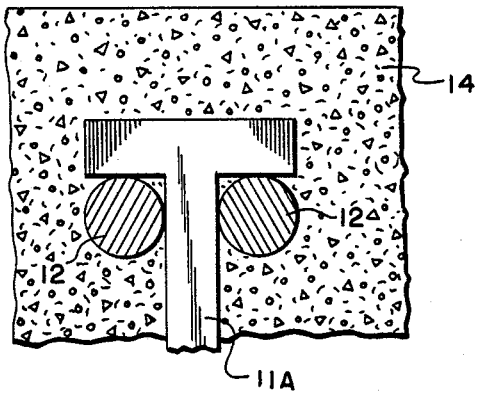
FIG. 5 represents the prior art, and is compared to FIG. 4.

FIG. 5 represents the prior art. Because stirrup 11A has a flat proximal surface compared to the inventive stirrup (compare 11 of FIG. 4), the reinforcing bar 12 will be unrestrained in lateral movement if the concrete 14 above and adjacent to the bars and stirrup undergoes cracking or spalling.

Alternate configurations will be apparent to those skilled in the art upon reading this specification. For example, the stirrup can be "L-shaped" instead of "T-shaped" at the crosspiece. This shape is satisfactory when only single longitudinal reinforcing bars are used, providing the crosspiece has a reentrant to restrain the single reinforcing bar.

The invention is particularly suited for structural elements of reinforcing concrete that will be subjected to high impact forces or punching shear, such as sea walls subject to collision from boats, barges, or thick ice. It will also be useful in many types of structural framing that are subject to high axial compression, including columns, diaphragms, walls, and the like. The added ductility will be of great benefit under accidental or extreme overloads, preventing progressive collapse and brittle failure. Improved characteristics can also be expected by incorporating this invention in critical performance structures including seismic and blast-resistant structures, ocean structures, ice-resistant structures, nuclear power plant containment vessels, and pressure vessels.

Savings in structure fabrication costs can also be realized because the stirrups can be quickly and simply inserted in place. Stirrups can be readily cut as a single unit from flat steel stock if desired, and automatic flame-cutting devices can provide further efficiencies if a large number of stirrups is needed. Alternatively, the stirrups can be cast as a unit, or the crosspieces can be individually attached to the shaft by welding or other means.

The length and other dimensions of the stirrup will, of course depend upon the specific size and desired placement of the reinforcing steel. The total length will often be only slightly less than the finished thickness of the concrete structure, where the reinforcing members are situated near the concrete surface. The width and thickness of the shaft and crosspiece are a function of the desired strength based upon expected forces, and the length of the crosspiece is determined by the size of the reinforcing member it is intended to restrain, as will be apparent from the remainder of this specification.

SPECIFIC EXAMPLE

Multiple stirrups of the type described above were made by automatic flame cutting of a 572 grade 60 steel plate with a thickness of $\frac{3}{4}$ inches to produce units having an overall length of 14 inches, a shaft width of $\frac{3}{4}$ inches, a crosspiece length of $2\frac{3}{4}$ inches, a minimum crosspiece width of $\frac{3}{4}$ inches, and an arc on the proximal surface of the crosspiece with a radius of $\frac{7}{8}$ inches.

Other stirrups as shown in FIG. 5 were made which did not contain an arc or reentrant on the proximal surface. These will be referred to as flat T-headed stirrups.

Two primary, large scale tests were conducted to examine the difference in performance between the flat T-headed stirrups and the stirrups of this invention.

Flat T-headed stirrups were used in the construction of a $41\frac{1}{2}$ by 16 by 16-inch reinforced concrete block. It was tested in direct compression up to 2.0 million lbs. of load. The carrying capacity of this specimen dropped off rapidly after failure in a non-ductile fashion due to buckling of the compression steel which the flat T-headed stirrups could not prevent. The compression reinforcing steel bars showed significant buckling at high strain rates.

The inventive T-headed stirrups were used in the construction of a second test speciment measuring 130 by 36 by 14 inches. This was tested in flexure with up to approximately 2.0 million lbs. of load. Along the compressive face of this specimen, extremely large buckling forces were imposed upon the compression reinforcing steel. The inventive T-headed stirrups provided adequate restraint to prevent the compression steel from moving laterally and buckling. The inventive stirrup allowed the test speciment to exhibit extreme ductility.

I claim:

1. A stirrup for restricting movement of a reinforcing member in concrete, comprising a shaft having a rigid crosspiece at both ends, with the crosspiece length being greater than the shaft width, each crosspiece being perpendicular to the shaft and parallel one to the other, and each crosspiece having a proximal and distal surface relative to the end of the shaft, said proximal surface having at least one reentrant defined by said rigid crosspiece.

2. The stirrup of claim 1 in which the shaft intersects each crosspiece at about the midpoint of the crosspiece.

3. The stirrup of claim 1 in which the reentrant is a concave arc.

4. The stirrup of claim 1 in which the shaft and crosspiece are cut from a single piece of flat steel.

5. A concrete structure comprising at least two parallel reinforcing bars, said reinforcing bars being restrained from vertical and lateral movement by a stirrup comprising a shaft having a rigid crosspiece at both ends, with the crosspiece length being greater than the shaft width, each crosspiece being perpendicular to the shaft and parallel one to the other, and each crosspiece having a proximal and distal surface relative to the end of the shaft, said proximal surface having at least one reentrant defined by said rigid crosspiece.

6. The structure of claim 5 which further comprises additional reinforcing bars situated transverse to and adjacent to said parallel reinforcing bars.

7. The structure of claim 5 in which the reentrant is a concave arc.

8. The structure of claim 7 in which the reentrant is a concave arc, and the radius of the arc is slightly longer than the radius of the reinforcing bar.

9. The structure of claim 5 in which the shaft intersects each crosspiece at about the midpoint of the crosspiece.

10. The structure of claim 9 in which the parallel reinforcing bars consist of pairs of reinforcing bars, with each pair adjacent to the shaft and the proximal surface of the crosspiece.

* * * * *